US006166697A

United States Patent [19]

Granqvist et al.

[11] Patent Number: 6,166,697

[45] Date of Patent: Dec. 26, 2000

[54] ANTENNA MEANS, A METHOD FOR ITS MANUFACTURING AND A HAND-HELD RADIO COMMUNICATION DEVICE

[75] Inventors: Henrik Granqvist, Stockholm; Thomas Bennet, Täby; Stefan Moren, Kista, all of Sweden

[73] Assignee: Allgon AB, Akersberga, Sweden

[21] Appl. No.: 09/277,769

[22] Filed: Mar. 29, 1999

[30] Foreign Application Priority Data

Apr. 1, 1998 [SE] Sweden ..... 9801155
Feb. 8, 1999 [SE] Sweden ..... 9900412

[51] Int. Cl.[7] ..... H01Q 1/24

[52] U.S. Cl. ..... 343/702; 343/906; 343/895

[58] Field of Search ..... 343/702, 906, 343/895, 715, 900, 901; H01Q 1/24

[56] References Cited

FOREIGN PATENT DOCUMENTS 0590534 4/1994 European Pat. Off. .
0718909 6/1996 European Pat. Off. .
195 47 191 6/1997 Germany .
WO97/49141 12/1997 WIPO .

*Primary Examiner*—Hoanganh Le
*Attorney, Agent, or Firm*—Jacobson, Price, Holman & Stern, PLLC

[57] ABSTRACT

The present invention relates to a problem, how to achieve a lighter and cheaper antenna and a more reliable and simple manufacturing and assembly process. These problems are solved by arranging a first contact (602, 707) to directly contact the radiating element (604, 702), and by a force enable contact, and to directly contact a feed member (610, 713) so that an conductive connection between the radiating element and the printed circuit board is obtained through the contact. An advantage, according to one embodiment of the present invention is that the amount of material in the base can be reduced since no seat is required for the contact clip retainer. Another advantage according the present invention is that a flexible contact is provided. Another advantage with the present invention is that only one end of the base is used for introducing parts resulting in an simpler assembly process and yet another advantage is that fewer parts are needed for the contact between the radiating element and the circuitry.

36 Claims, 11 Drawing Sheets

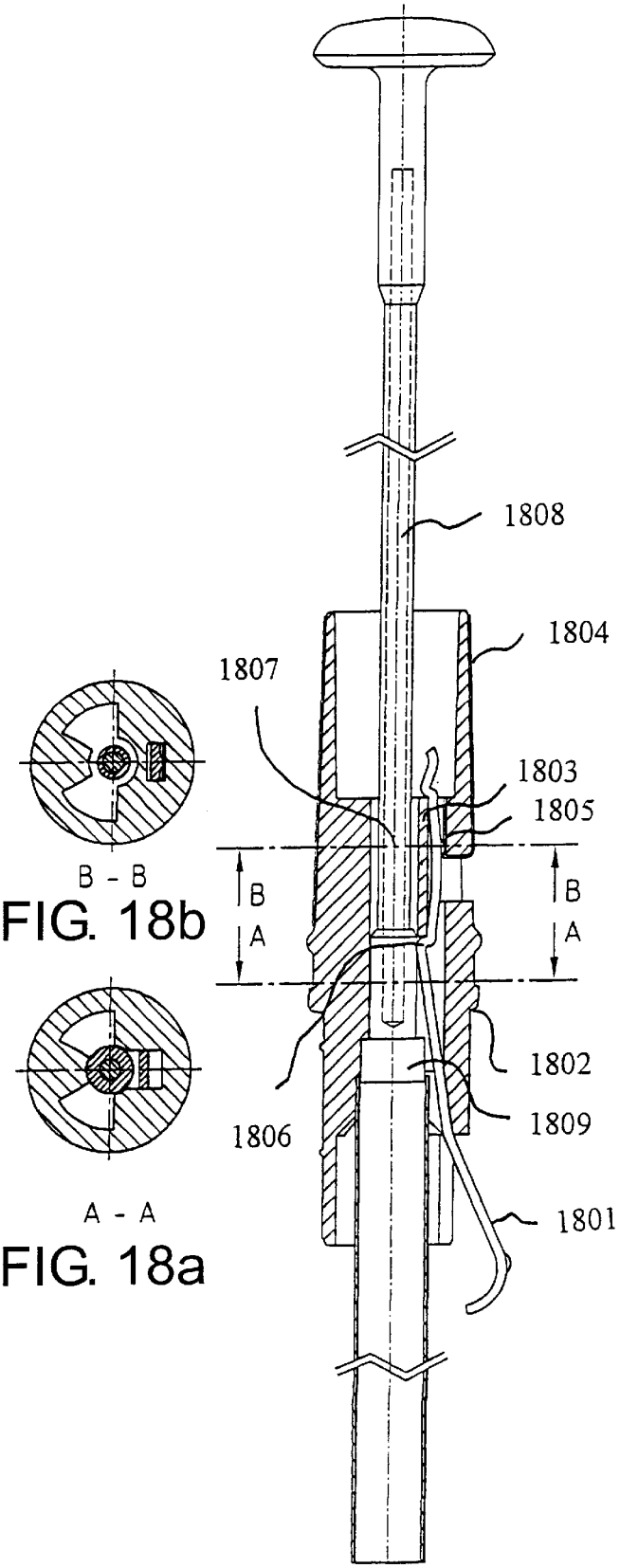
B - B
FIG. 18b
A - A
FIG. 18a
FIG. 18
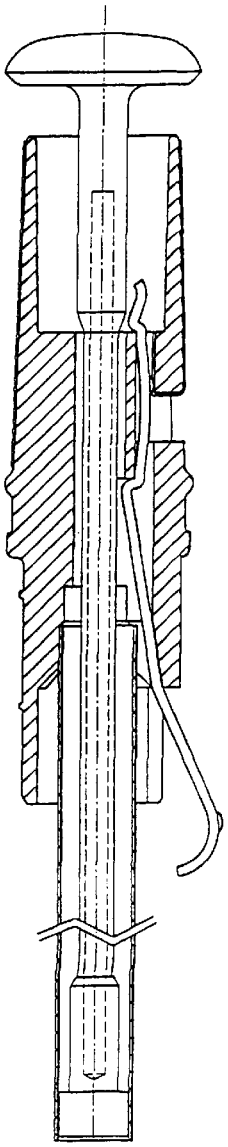
FIG. 19

ANTENNA MEANS, A METHOD FOR ITS MANUFACTURING AND A HAND-HELD RADIO COMMUNICATION DEVICE

TECHNICAL FIELD OF INVENTION

The present invention relates to antennas in general and to a light-weight antenna, an efficient manufacturing process for antennas for hand-held radio devices, and a hand-held radio communication device in particular.

DESCRIPTION OF RELATED ART

Antennas in general and antennas for hand-held radio devices in particular are going through a rapid evolution towards smaller sizes and lighter weight. The demands in the mobile radio business for smaller and lighter devices forwards requirements also to the antennas for such devices.

The current market volume of hand-held radio devices and the expected increase in market volume also puts high requirements on the manufacturing process for all components in such devices. Even relatively small improvements can result, due to large quantities, in large cost savings.

For these reasons it is extremely important to find improvements in the manufacturing process and to implement these to achieve a competitive advantage.

The current state of art for manufacturing of antennas for hand-held radio devices, further described under preferred embodiments with references to FIGS. 1 to 4, involves problems with a complicated contact clip and contact clip retainer handling the electrical connection between the two main components, namely the radiating element and the printed circuit board. The contact clip retainer being a relatively heavy part of the antenna, needing a seat in the base which seat in turn require a fair amount of plastic.

The contact clip retainer is used for fixing a contact clip to the radiating element and connect the radiating element with the contact clip. The contact clip retainer is introduced into the cavity of the base from the top while the contact clip is introduced from the bottom of the base. The need to introduce parts from two different directions into the base results in a complicated manufacturing process where the base must be turned around and additional steps in the process must be taken.

In one prior art device, presently being manufactured by the applicant, (see for instance WO 97/49141 Meander Antenna) where a meander is used as a radiating element a small part of the meander is folded into an inlet on the side of the base and downwards so that when the contact clip retainer is introduced from the top it is forced against the folded part of the meander. The folded part is folded in the 'wrong' direction downwards, as will be shown under preferred embodiments, which could cause a slit in the plastic carrier of the radiating pattern, enabling a small folding part of the meander, to cut off the electrical connection between the folded part and the radiating element, thus making electrical contact between the printed circuit board and the radiating element impossible. Another problem which might occur is that the contact clip retainer might damage the folded part of the radiating element when the contact clip retainer is introduced into the base.

The contact clip is then introduced from the bottom and is forced in place, making conductive contact with the contact clip retainer through two legs at the top of the contact clip interacting with the contact clip retainer. Several problems exist with the legs on the contact clip. Since the legs are taken out on the contact clip, the clip could exibit a tendency the bend at the waist. The legs have a tendency to hook into each other and thereby halting the assembling machine. The manufacturing of the contact clip is complicated with high precision tools which wear down and breaks.

SUMMARY OF INVENTION

The object of the present invention is thus to achieve a lighter and cheaper antenna and thereby a lighter and cheaper hand-held radio communication device.

Another object of the present invention is to achieve a more reliable and simple assembly process for assembling an antenna device.

Another object of the present invention is to provide a connection between the main radiating element, or elements and the circuitry with as few parts as possible.

Yet another object of the present invention, according to one preferred embodiment, is to achieve a more reliable contact clip which also is more suitable for assembly.

The problems described above, how to achieve a lighter and cheaper antenna and a more reliable and simple manufacturing and assembly process is solved by arranging a first means to directly contact the radiating element, and by a force enable coupling between said means and said radiating element, and to directly contact a feed member on, for instance a printed circuit board, so that a conductive connection between the radiating element and the printed circuit board is obtained through said means.

In more detail the objects of the present invention, how to achieve a lighter and cheaper antenna and a more reliable and simple assembly and manufacturing process, are obtained, according to one embodiment, by providing an antenna for receiving and transmitting electromagnetic radiation comprising a radiating element, a base and a contact clip, said base comprising a cavity extending mainly in axial direction, at least a first inlet to said cavity in axial direction and at least a second inlet to said cavity in radial direction, said radiating element being arranged to at least partly fold into said cavity through said second inlet onto a first contact area on the wall in said cavity. Said base further comprises a support means extending from one side in said cavity in a mainly radial direction, that said contact clip is being fixed between a support area, said support means and said first contact area so as to create a spring force between said support means, said support area and said first contact area, enabling electrical contact between said contact clip and said radiating element.

An advantage with the present invention is that one part of the antenna can be eliminated.

An advantage, according to one embodiment of the invention, is that the contact clip retainer can be eliminated.

Another advantage, according to one embodiment of the present invention is that the amount of material in the base can be reduced since no seat is required for the contact clip retainer.

Another advantage according to one embodiment of the present invention is that a flexible contact is provided.

Another advantage with the present invention is that only one end of the base is used for introducing parts resulting in a simpler assembly process.

Yet another advantage, according to one embodiment of the present invention, where a meander is used as a radiating element, is that when the meander is folded into the cavity of the base, it is folded so that there is a minimal risk that the slit destroys the connection between the folded part and the radiating element.

Yet another advantage is that fewer parts are needed for the contact between the radiating element and the circuitry.

Another advantage, according to one embodiment of the present invention is that no legs are required on the contact clip.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein FIG. 18 shows an antenna according to a preferred embodiment of the invention comprising an extendable whip in extended position, FIG. 18*a* shows a cross sectional view of the antenna in FIG. 18 taken at line A—A, FIG. 18*b* shows a cross sectional view of the antenna in FIG. 18 taken at line B—B, FIG. 19 shows an antenna according to a preferred embodiment of the invention comprising an extendable whip in retracted position.

DETAILED DESCRIPTION OF PREFERRED EMBODIMENTS

Figure 1:
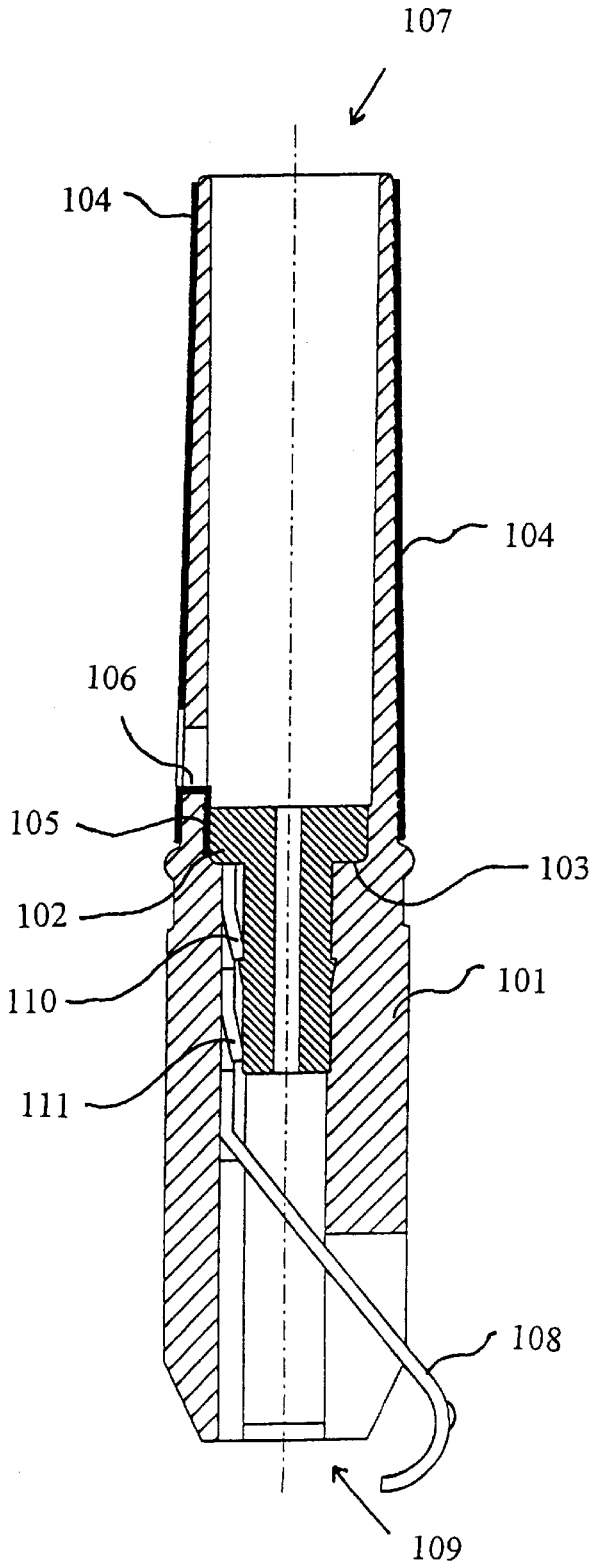
FIG. 1 (PRIOR ART)
FIG. 1 shows an antenna according to the prior art.

FIG. 1 shows an sectional view of a prior art antenna. With 101 is a base denoted and with 102 is a contact member denoted. The contact member 102 is fixed in the cavity of the base with aid of a seat 103.

The contact member 102 is of solid metal and is therefore relatively heavy. It also requires a seat 103 in the base to be securely fixed, which seat 103 also requires an extra amount of plastics.

A radiating element, in this case a meander is denoted 104. A small part 106 of the meander 104 is folded downwards inwards and is in contact with the contact member 102 at a contact area 105. The coupling between the contact member 102 and the folded part 106 of the meander 104 is achieved when the contact member 102 is introduced into the top of the cavity 107 of the base 101 and forced downwards.

It obvious that when the contact member 102 is forced down to achieve contact with the folded part 106, the brut force might damage the electrically conductive part on the folded part 106.

A contact clip 108 is introduced from the bottom 109 of the cavity. Since it is necessary to introduce parts into the cavity in two different ends of the base a more complicated assembly process is required where the base needs to be turned.

Two legs 110 and 111 of the contact clip 108 cooperates with the contact member 102 to fix the contact clip 108 and to achieve coupling between the contact clip 108 and the contact member 102. The two legs 110 and 111 from different contact clips 108 easily hook into each other during the manufacturing process where a large amount of contact clips 108 are kept in a single container.

Figure 2:
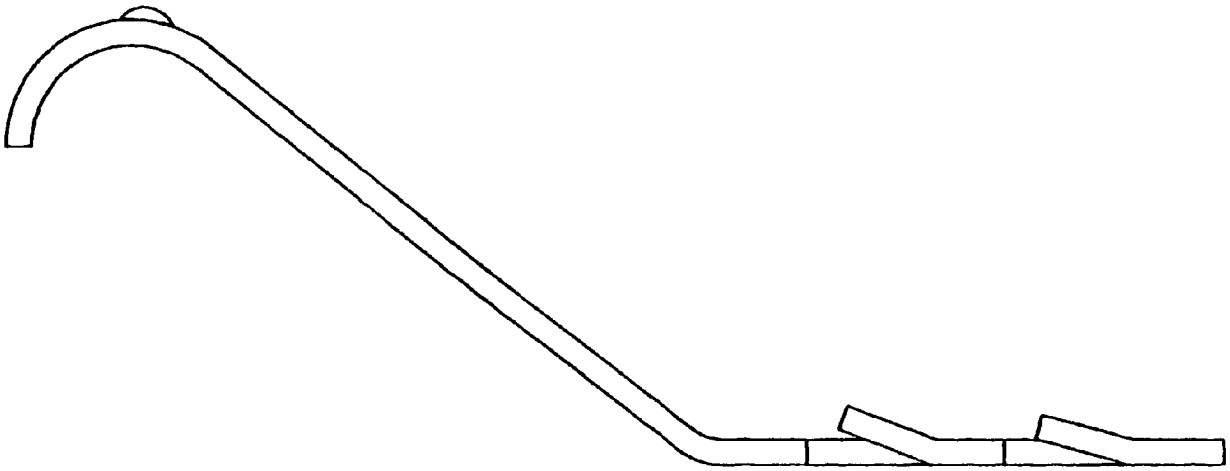
FIG. 2 (PRIOR ART)
FIG. 2 shows a side view of a contact clip according to the prior art.
Figure 3:
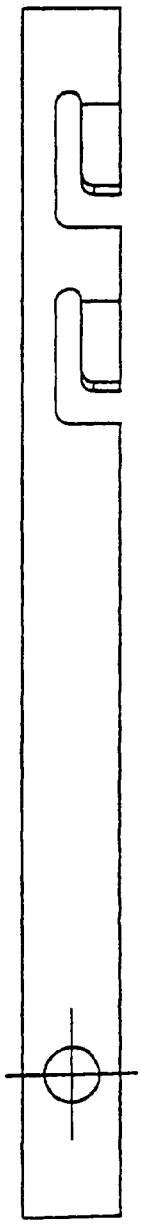
FIG. 3 (PRIOR ART)
FIG. 3 shows a top view of a contact clip according to the prior art.

In FIG. 2 a contact clip is shown according to the prior art from a side view and in FIG. 3 the same contact clip is shown from a top view. One can easily imagine that the contact clips can hook into each other.

Figure 4:
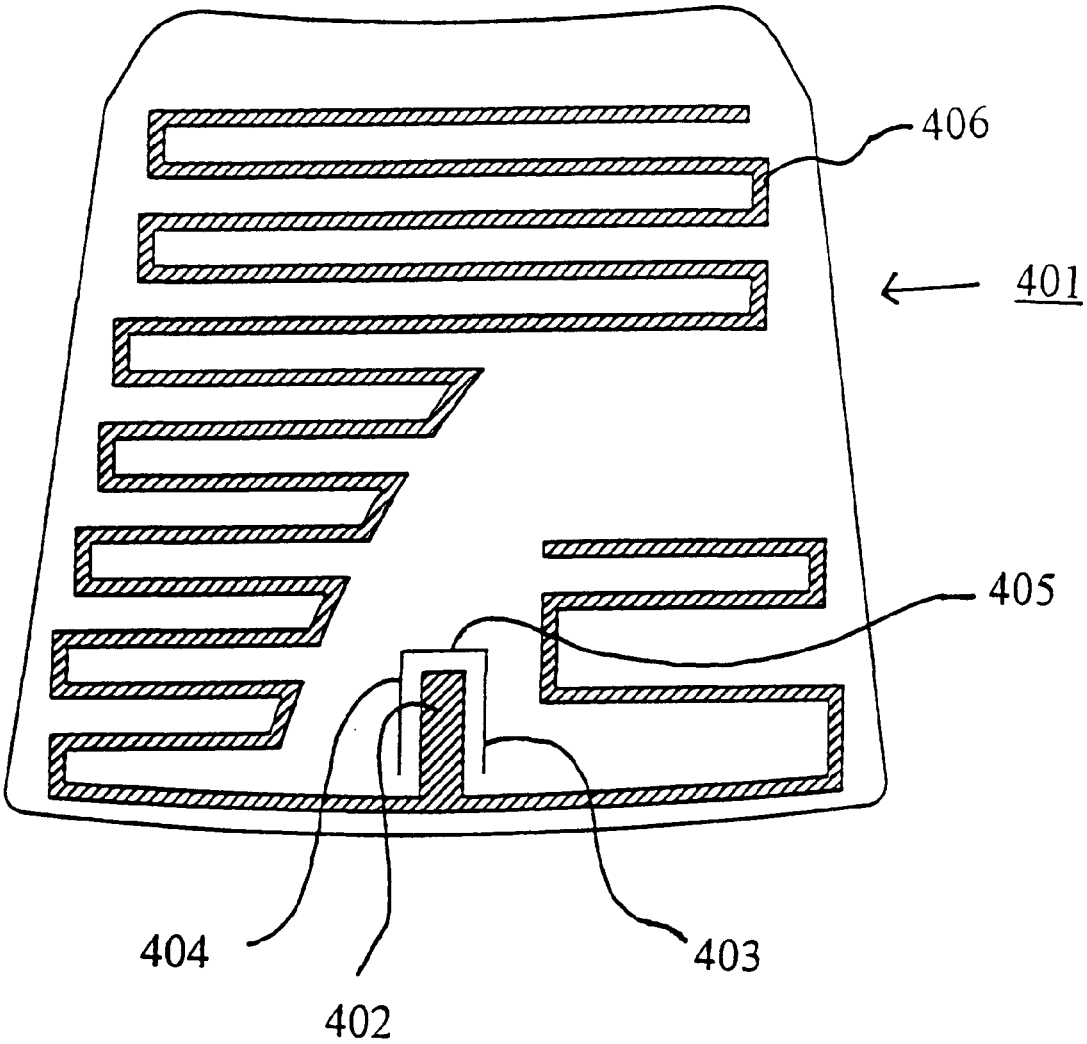
FIG. 4 (PRIOR ART)
FIG. 4 shows a radiating element according to the prior art.

In FIG. 4 is a radiating element, in this case a meander 401, shown according to the prior art. With 402 is a foldable part denoted and with 403 and 404 are two slits denoted. A third slit is denoted 405. The meander 401 is applied to the base 101 in FIG. 1 and the foldable part 402 is folded inwards downwards into to the cavity. If this folding is not performed with enough accuracy the folded part 402 might increase in size through extensions of the slit 403 and 404. If this happens the slit 403 might completely cut off the conductive line connecting the conductive part of folded part 402 with the radiating part 406. Since the folded part 402 needs to be as close to the bottom of the meander 401 as possible a relatively short damage may cut off the line. This is of course a problem.

The term meander is used in this description to define a thin dielectric carrier with a meander shaped conductive element. It is easly realized that the conductive element can have other shapes than a meander shape. When it is described that the meander has a slit it is really the carrier which has the slit.

Figure 5:
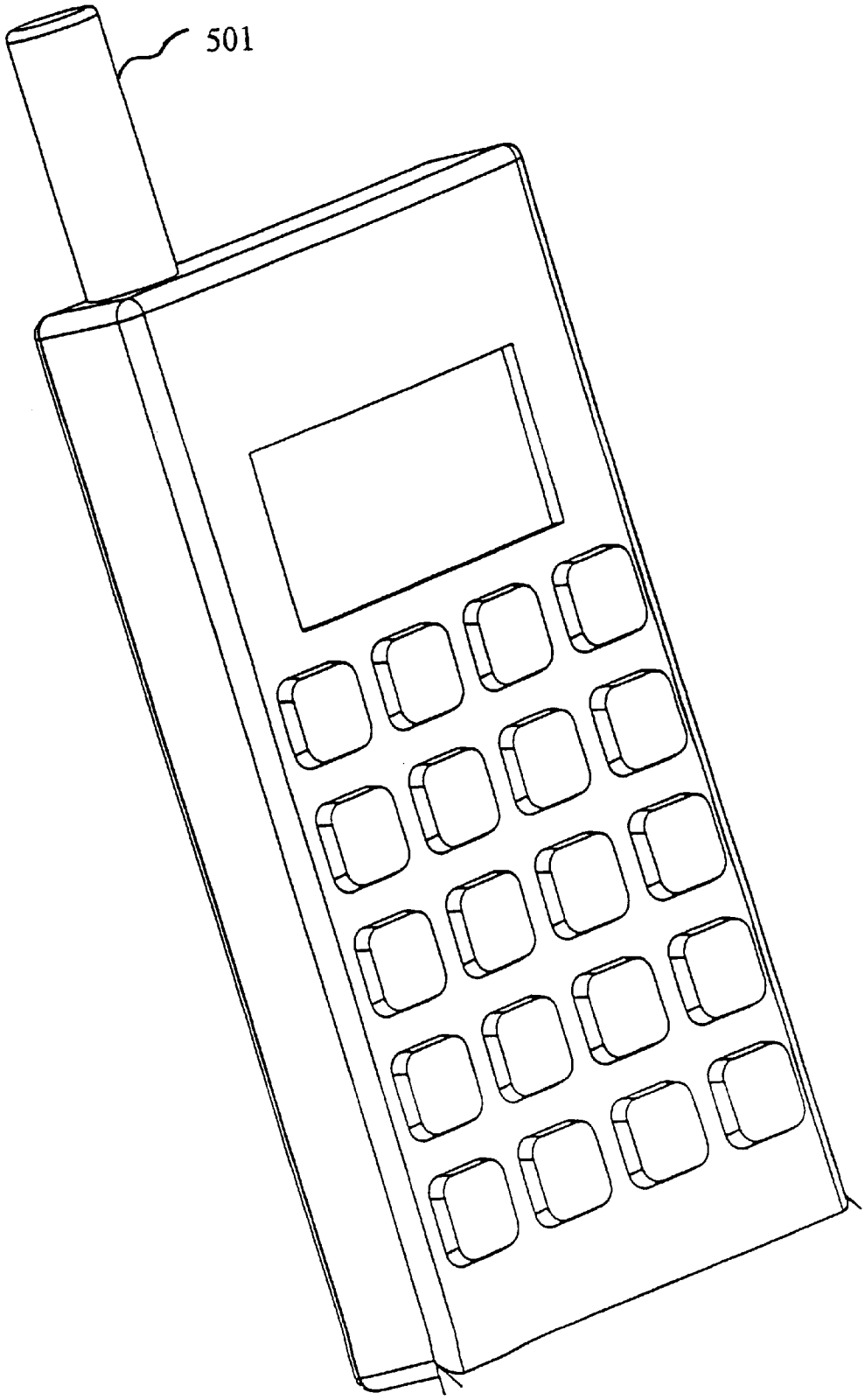
FIG. 5 shows a hand-held radio communication device with an antenna according to one embodiment of the invention.

FIG. 5 shows a hand-held radio communication device comprising an antenna according to the invention. The antenna means might be screwed onto the communication device or snap-clicked onto same, in FIG. 5 is also a cap denoted 501 clearly visible. The cap 501 is for protecting the antenna parts.

Figure 6:
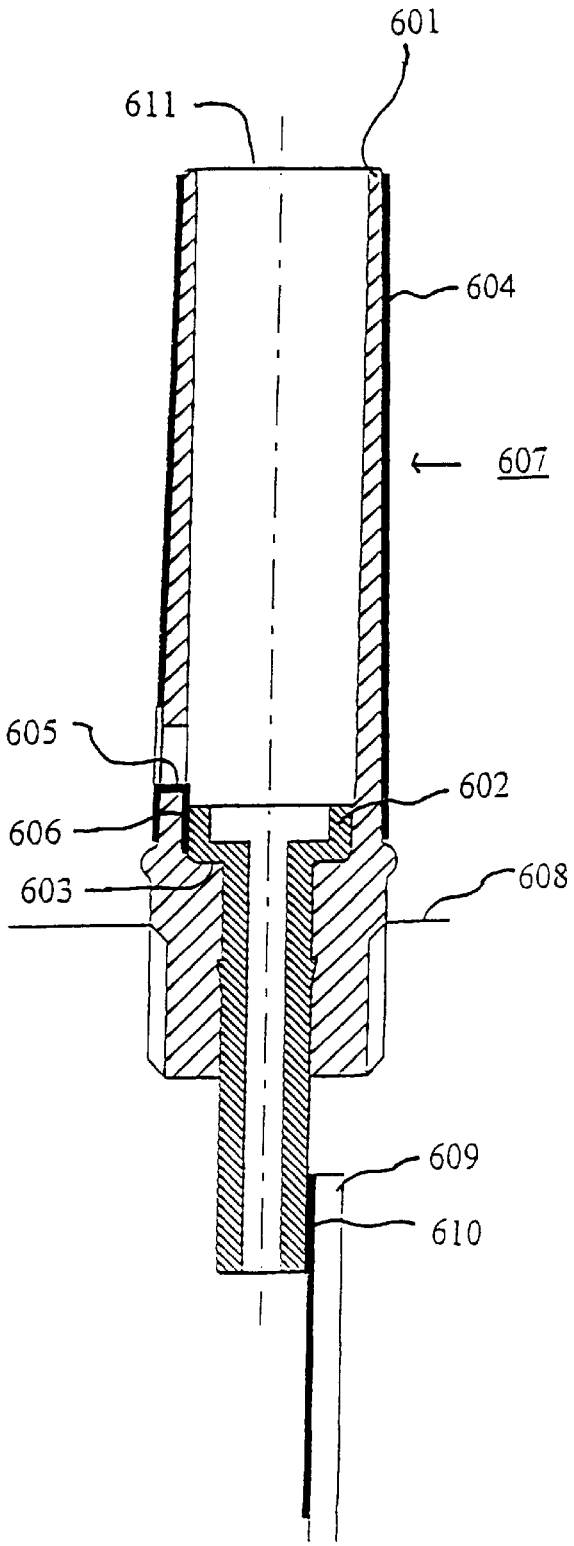
FIG. 6 shows an antenna in a sectional view according to a first embodiment of the invention.

FIG. 6 shows an antenna according to one embodiment of the invention. With 601 is a base denoted and 602 denotes a contact means in the form of a contact spool, having generally a cylindric, elongated shape. The contact spool 602 is fixed into position with aid of a seat 603. A radiating element 604 comprises a folded part 605 which is folded into the cavity of the base 601 towards a contact area 606. Conductive contact is achieved between said contact spool 602 and said folded part 605 when said contact spool is introduced into the cavity from a first inlet 611 at the top and forced downwards. A force from the surrounding walls of the contact spool 602 forces the contact spool 602 towards the folded part 605 providing conductive contact between the contact spool 602 and the conductive area on the folded part 605. The antenna 607 is screwed onto a hand-held radio communication device and the contact spool couples to a feed member 610 on a printed circuit board 609.

A cavity as used in this text is a broad term describing a space, which can be open in one or more end. It need not to have a particular shape, nor need it to have walls surrounding it on all sides, in this sense even a half-sphere would define a cavity. Even if the base in FIG. 6 where to be filled with a filler after that the contact spool have been put in place, the space taken by the contact spool itself would define a cavity of the base, even though the cavity being filled by the contact spool.

Figure 14:
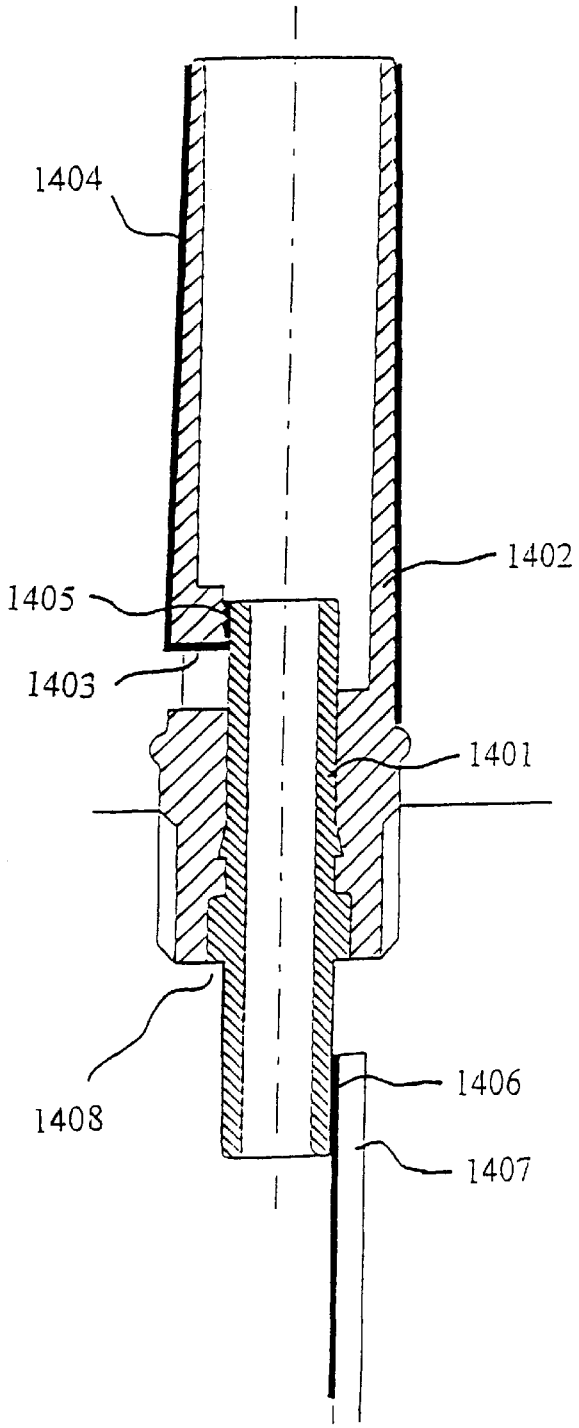
FIG. 14 shows an antenna according to a fourth embodiment of the invention.

In FIG. 14 is the contact spool 1401 introduced into the cavity of the base 1402 from a first inlet 1408 at the bottom and forced up. In this embodiment is thus a folded part 1403 of a meander 1404 folded upwards to a contact area 1405. The contact spool 1401 is forced against the folded part 1403 providing electrical coupling between the meander 1404 and a feed member 1406 on a circuit 1407.

Figure 7:
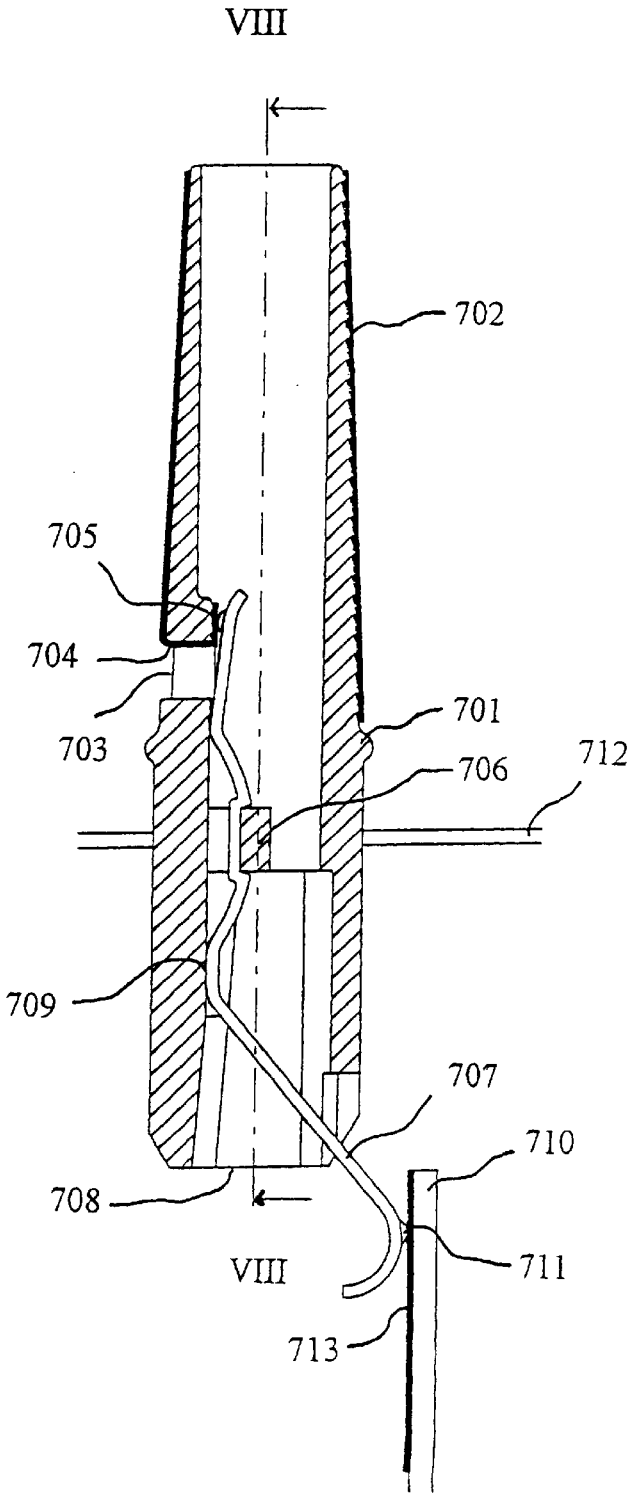
FIG. 7 shows an antenna in a sectional view according to a second embodiment of the invention.

FIG. 7 shows an antenna according to another embodiment of the invention. A base is denoted 701 and a radiating element, in the form of a meander shaped conductive area on a thin dielectric carrier, hereinbelow called meander, is denoted 702 which is applied to the base 701 in an conventional way well known in the prior art, such as with an adhesive. A first inlet in radial direction is denoted 703. A part 704 of the meander 702 is folded inwards upwards into the cavity of the base 701 through the inlet 703 towards a first contact area 705. A support means, denoted 706, is extending from one side of the cavity in the base 701 in mainly radial direction. A contact means in the form of a contact clip is denoted 707. The contact clip is introduced into the cavity of the base 701 through a second inlet 708 in the bottom of the base 701 and under the support means 706. The contact clip 707 is snapped into position and fixed in place through spring forces between the support means 706, the first contact area 705 and a support area 709. The contact clip 707 connects to the folded part 704 of the meander 702, and to a feed member 713 printed circuit board 710 through a third contact area 711 enabling an electric circuit between the radiating element 702 and the printed circuit board 710.

The connection between the contact clip 707 and the folded part 704 of the meander 702 is achieved through spring forces in the contact clip 707 exerting a force towards the side of the cavity of the base 701 at the contact area 705.

The base 701 is snap-clicked in place on a hand-held radio communication device 712. A cap is usually also present to protect the radiating element, but the cap is not shown in FIG. 7 for sake of clarity.

Figure 8:
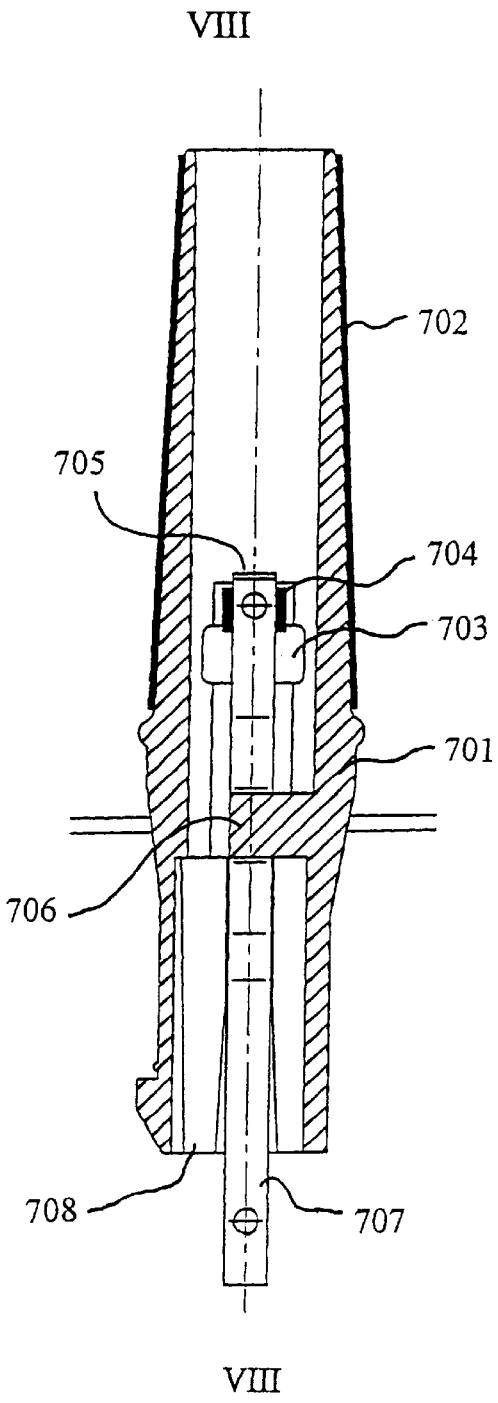
FIG. 8 shows the antenna of FIG. 7 in a sectional view taken at VIII—VIII.

FIG. 8 shows the same embodiment as shown in FIG. 7. Corresponding parts has been denoted with the same numbers in FIG. 8 as in FIG. 7.

Figure 9:
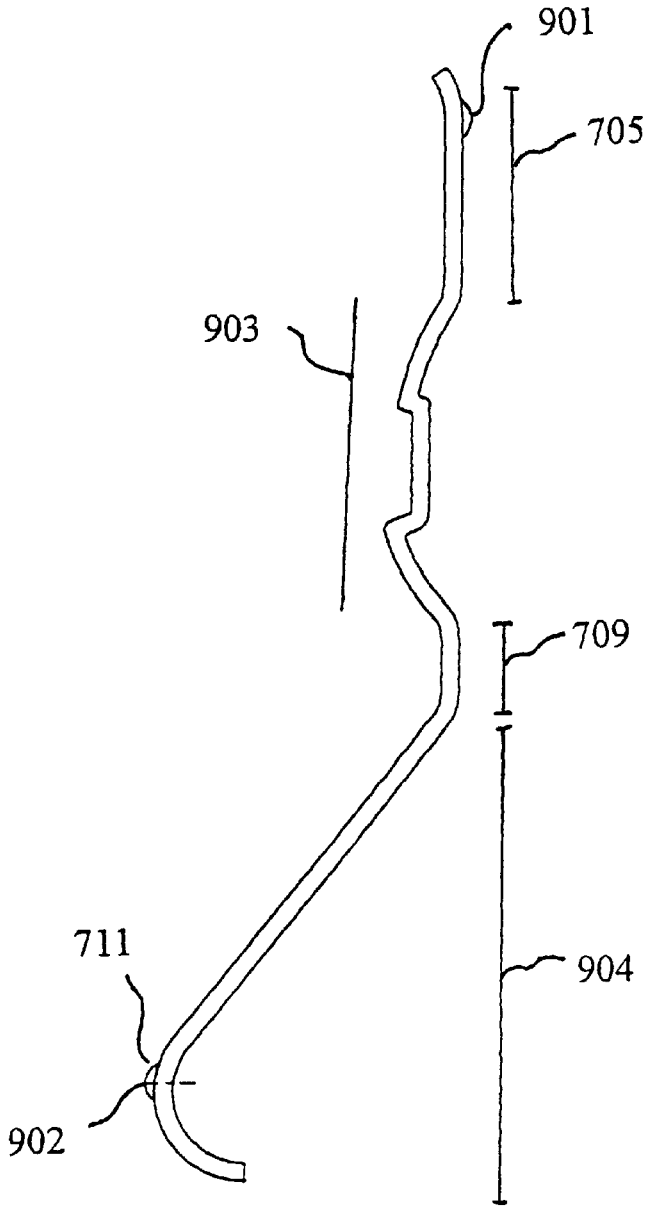
FIG. 9 shows a side view of a contact clip according to one embodiment of the invention.
Figure 10:
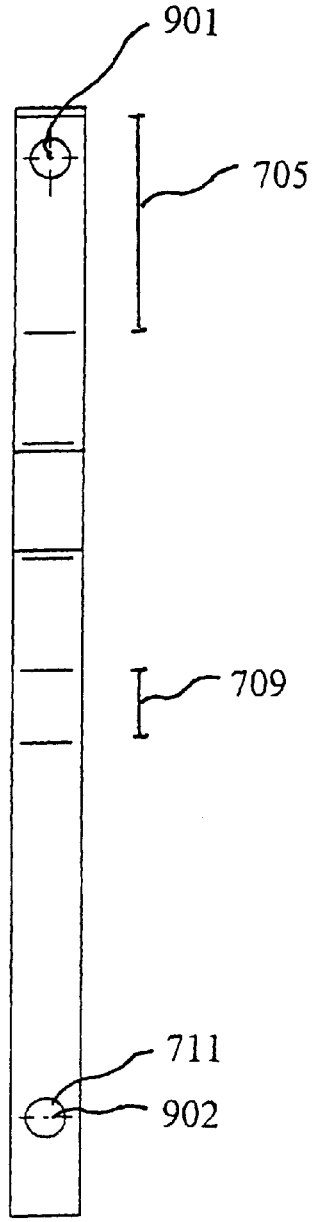
FIG. 10 shows a top view of the contact clip in FIG. 9.

FIGS. 9 and 10 shows a close up view of the contact clip in the embodiment disclosed in connection with FIG. 7 and FIG. 8. Corresponding parts has been denoted with the same numbers in FIGS. 9 and 10 as in FIG. 7. In FIGS. 9 and 10 it is more clearly shown that the contact area 705, 709 and 711 need necessarily not be very small areas but could also be longer parts of the contact clip 707 as indicated in FIGS. 9 and 10. This is important since the contact area 705 has two purposes, namely both fixing the contact clip and connect the contact clip 707 with the radiating element 702. In FIG. 9 is a first boss-like protrusion denoted 901 and a second boss-like protrusion denoted 902. These protrusions are used to achieve a more secure coupling between the contact clip and the radiating element 702 and the printed circuit board 710. In FIG. 10 the protrusions are denoted as in FIG. 9.

In FIGS. 9 and 10 the form of the contact clip is clearly shown with the first contact area 705 followed by a mainly convex part 903. The convex part ends in the support area 709 which is mainly in the same plane as said first contact area 705. The support area continues in an elongated part 904 which is mainly convex and ends in the third contact area 711.

Figure 11:
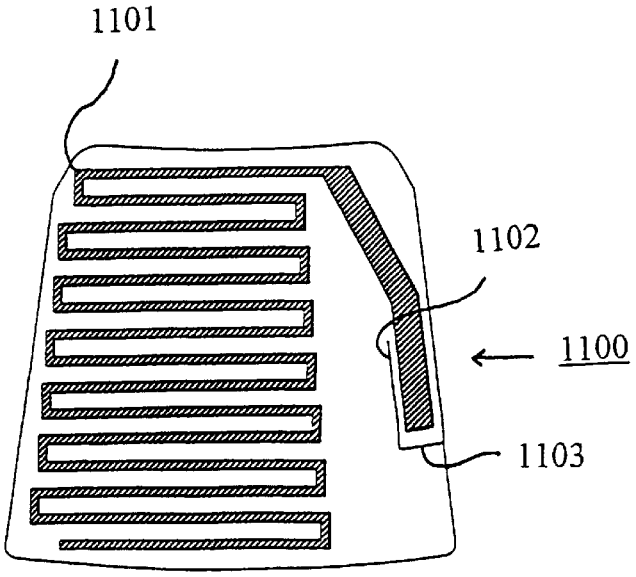
FIG. 11 shows a radiating element according to one embodiment of the invention.
Figure 15:
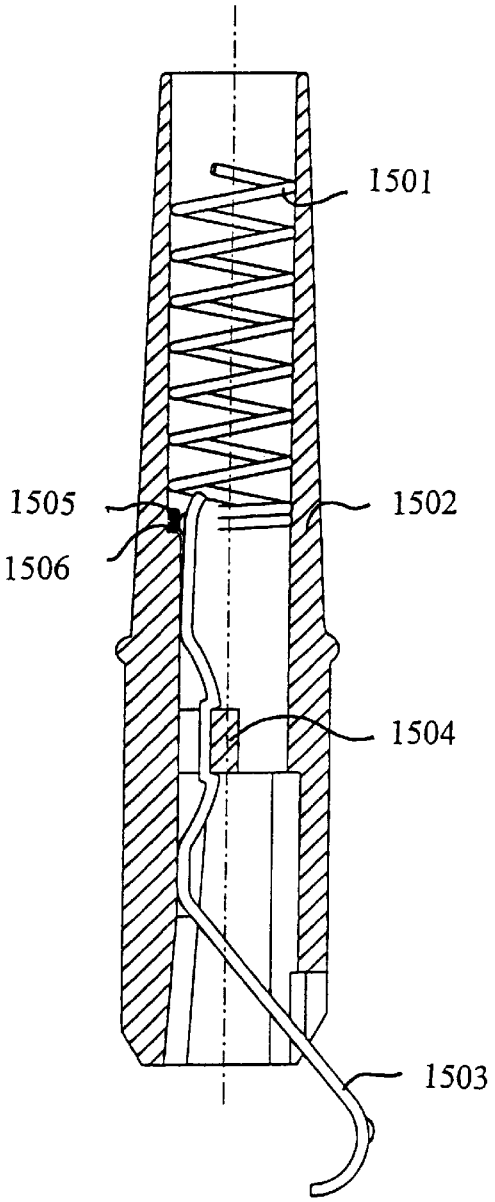
FIG. 15 shows an antenna according to a sixth embodiment of the invention.

FIG. 11 shows a radiating element in the form of a meander. With 1101 is a radiating pattern denoted. With 1102 is a first slit denoted and with 1103 is a second slit denoted. In this figure the benefit of folding a part of the meander upwards is clearly shown. If the fold is not perfectly performed and the slit rips the meander no real damages will occur since no radiating pattern is close to the slit.

Figure 12:
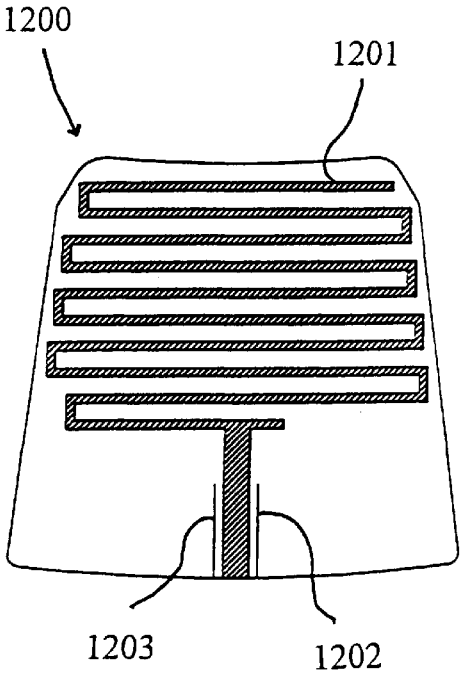
FIG. 12 shows a radiating element according to another embodiment of the invention.

FIG. 12 shows a radiating element according to another embodiment of the invention. With 1201 is a radiating pattern denoted and with 1202 and 1203 is a first and a second slit denoted. Also in this embodiment is it clear that a rip in any of the first or second slit 1202 or 1203 will not cause any damages.

Figure 17:
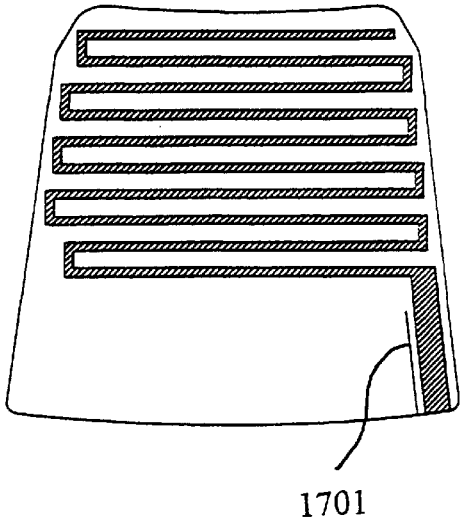
FIG. 17 shows an radiating element according to an embodiment of the invention.

FIG. 17 also shows and meander antenna where only one slit enables a part of the meander to fold.

Figure 13:
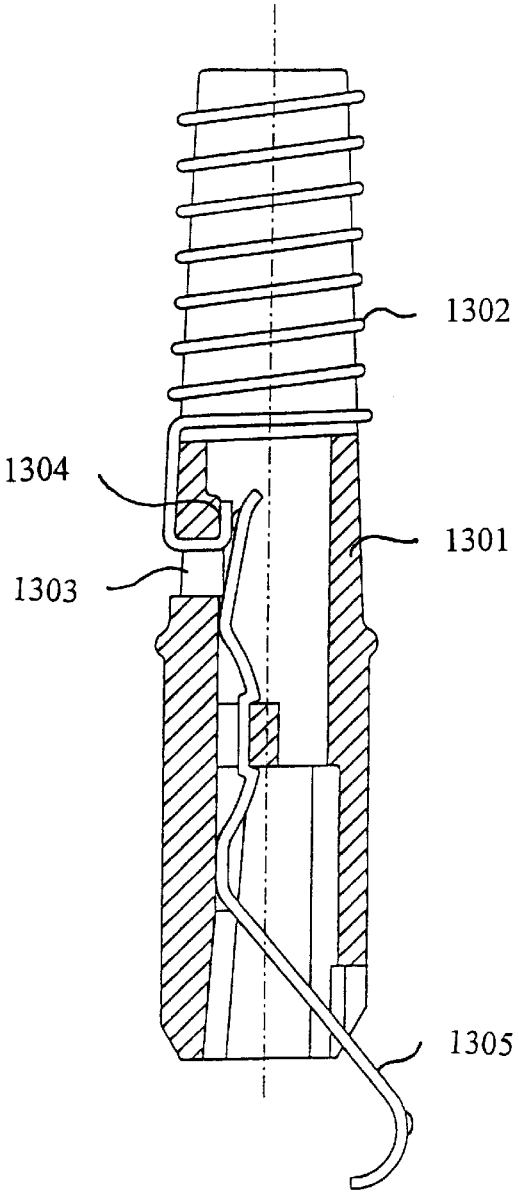
FIG. 13 shows an antenna in a sectional view according a third embodiment of the invention.

FIG. 13 shows a third embodiment of the invention. A base is denoted 1301 and in this embodiment the radiating element is a helical radiator denoted 1302. A part of the helical radiator 1302 is folded into a first inlet 1303 towards a first contact area 1304 in the cavity of the base 1301. A contact clip 1305 is introduced into the cavity and a conductive contact is established between the contact clip 1305 and the helical radiator 1302 at the contact area 1304 in a way analogous to the embodiment described in connection with FIG. 7.

FIG. 14 shows an helical antenna means 1501 located inside a cavity of a base 1502. A contact clip 1503 is forced and retained under a support means 1504. A part 1506 of the helical antenna 1501 is partly covering a contact area 1505 and the contact clip 1503 is, through spring forces, forced against said contact area 1505 enabling electrical contact between said helical antenna 1501 and said contact clip 1505.

Figure 16:
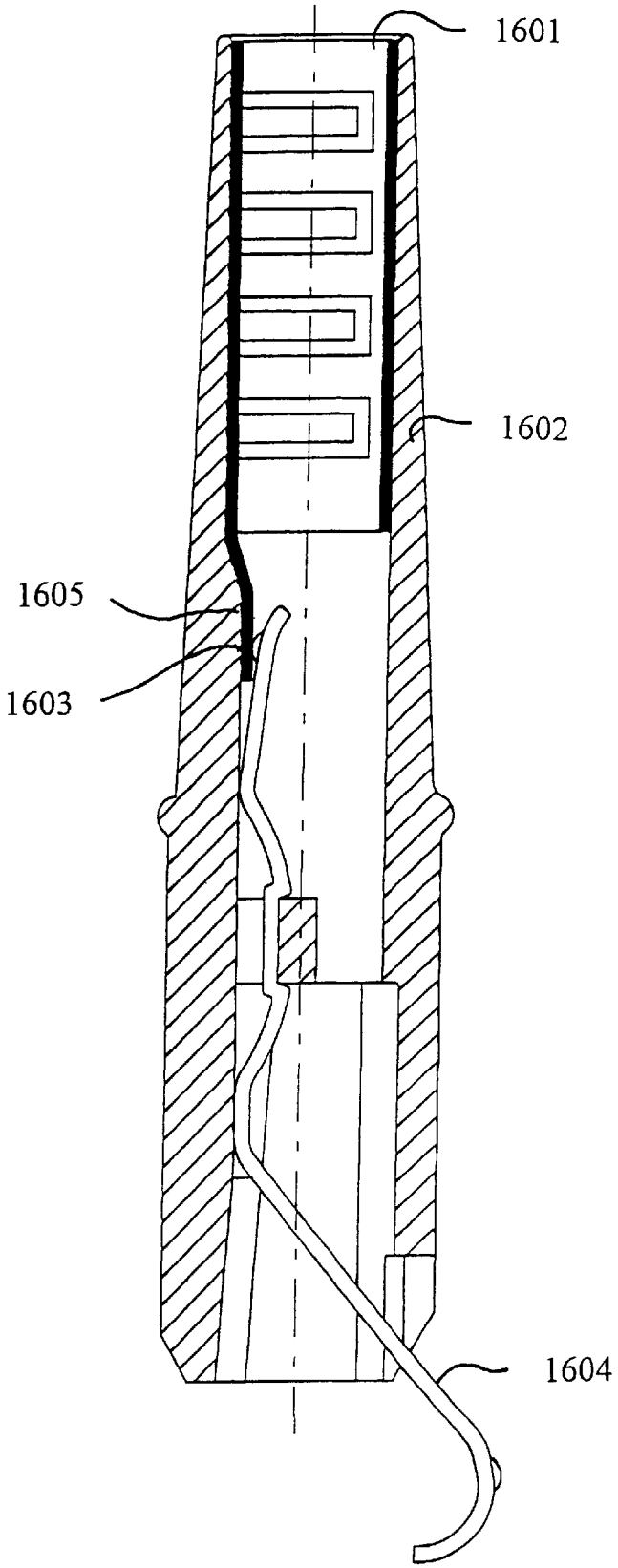
FIG. 16 shows an antenna according to a seventh embodiment of the invention.

FIG. 16 shows an embodiment of the invention where a meander antenna 1601 is fastened at an inside wall of the base 1602 so that at least a part 1605 of said meander 1601 is covering a contact area 1603.

FIG. 18 shows another preferred embodiment according to the invention where it is disclosed how an extendable radiating whip 1808 is included in the inventive concept. A contact clip 1801 is inserted in a base between the base outer wall 1802 and a transverse support means 1803. The contact clip is fixedly mounted using projections and its own spring action. A cylindrically configured radiating element 1804 is mounted on the base 1802 and has a tab 1805 which is folded into the base 1802 in a first contact area. The contact clip is forced by its spring action, against said tab in said contact area to provide electrical conductive contact between the radiating element 1804 and the contact clip 1801. This is essentially similar to what has been describe above.

The contact clip 1801 has a curved portion 1806 which extends somewhat into a central axially extending hole 1807 in which said extendable radiating whip 1808 is located. The whip 1808 is in one end equipped with a stopper 1809 which has a greater radius than a middle portion of said radiating whip 1808. A narrower part of said hole 1807 prevents the stopper 1809 from passing so that a maximum extension is achieved. When in this extended position the contact clip 1801 is forced against the stopper 1809 enabling electrical contact between the contact clip 1801 and the radiating whip 1808. The stopper 1809 can be a conductive metallic stopper in which case a conductive coupling between the contact clip 1801 and the whip 1808 is achieved, or it can be made of a dielectric material in which case the contact clip and the radiating whip is inductively and/or capacitively coupled.

FIG. 18*a* shows a cross-sectional view taken at A—A, and FIG. 18*b* shows a cross-sectional view taken at B—B.

FIG. 19 shows the extendable whip in retracted position.

The invention being thus described, it will be obvious that the same may be varied in many ways. For instance, more than one contact clip could be used, so as to form a transmission line from the feed member to the radiating element. More than one radiating element may be used in any combinations, such as a meander on both the inside and the outside of the base, a meander on the inside and a helix on the outside of the base, a helix on the inside and a meander on the outside, and finally a helix on both outside and inside of the base. It is also possible to imagine having more than two radiating elements such as an antenna rod, preferably extendible for increased efficiency in active mode. An antenna rod may of course also be part as a second radiating element, preferably in combination with the contact spool arrangement. Another variation may be to include a matching circuit for instance on the carrier of the meander element. Variations are not to be regarded as a departure from the spirit and scope of the invention, and all such modifications as would be obvious to one skilled in the art are intended to be included within the scope of the following claims.

What is claimed is:

1. An antenna device for receiving and transmitting electromagnetic radiation comprising:

at least a first radiating element and a base, said radiating element having an element part, said base comprising a cavity extending mainly in an axial direction and at least a first inlet to said cavity, said base further comprising:

a contact means being comprised of one single element and being arranged for creating coupling between said radiating element and a feed member, said contact means being arranged to be introduced into the cavity through the first inlet, said radiating element being arranged so that at least a part of said radiating element is provided in a first contact area, said contact means being arranged to exert a contact force against said first contact area, said force enabling coupling between said element part of said radiating element and said contact means, and said contact means being arranged to enable coupling with said feed member.

2. The antenna device according to claim 1, wherein said antenna device further comprises a first extendable radiating whip which is slidable between an extended and a retracted position, said contact means being further arranged to exert a contact force against said radiating whip in said extended position so as to provide coupling between said extended radiating whip and said feed member.

3. The antenna device according to claim 1, wherein said contact means extends out from said base.

4. The antenna device according to claim 1, wherein said radiating element is arranged mainly in the cavity of said base.

5. The antenna device according to claim 1, wherein said at least first inlet to said cavity is in a radial direction, said radiating element is arranged mainly on the outside of said base, said radiating element being arranged to at least partly fold into said cavity through said first inlet towards and on to said first contact area.

6. The antenna device according to claim 1, wherein said contact means is a contact spool, said contact spool is arranged to be introduced into said cavity from one end of said base in an axial direction, a side of said contact spool is forced against said first contact area through pressure forces from the surrounding walls providing contact between said contact spool and said part.

7. The antenna device according to claim 1, wherein said contact means is a contact clip, said base further comprises a support means extending from one side in said cavity in a mainly radial direction, said contact clip is retained between a support area, said support means and said first contact area so as to create a contact force between said contact clip and said first contact area, enabling coupling between said contact clip and said radiating element.

8. The antenna device according to claim 1, wherein said coupling between said contact means and said part is conductive.

9. The antenna device according to claim 1, wherein said coupling between said contact means and said part is capacitive.

10. The antenna device according to claim 1, wherein said coupling between said contact means and said part is inductive.

11. The antenna device according to claim 1, wherein said radiating element has meander shape.

12. The antenna device according to claim 1, wherein a thin dielectric carrier, arranged for carrying a radiating element, comprises at least a first slit so as to enable a part of said carrier to fold into said first inlet towards and on to said first contact area in said cavity.

13. The antenna device according to claim 12, wherein said carrier being fastened with adhesive.

14. The antenna device according to claim 1, wherein said radiating element is a helical radiator.

15. A method for manufacturing an antenna for receiving and transmitting electromagnetic radiation comprising a radiating element and a base, said base comprising a cavity extending mainly in axial direction and at least a first inlet to said cavity, wherein said radiating element is fastened to said base so that at least a part of said radiating element cover a first contact area, a contact means being comprised of one single element is introduced into said cavity through said first inlet, said contact means is forced into contact with said at least part of said radiating element covering said first contact area, enabling electrical contact between said contact means, said radiating element and a feed member.

16. The method according to claim 15, wherein said radiating element is fastened mainly in the cavity of said base.

17. The method according to claim 15, wherein said base further comprises a second inlet in mainly radial direction, said radiating element is fastened mainly on the outside of said base, a part of said radiating element is folded into said cavity through said second inlet towards and on to said first contact area.

18. The method according to claim 15, wherein said contact means is a contact spool, said contact spool is forced against said first contact area through pressure forces from the surrounding walls providing coupling between said contact spool and said part.

19. The method according to claim 15, wherein said contact means is a contact clip, said contact clip is forced under a support means extending from one side in said cavity in a mainly radial direction and retained in position under spring forces between said contact clip, a support area, said support means and said first contact area enabling electrical contact between said contact clip and said radiating element.

20. The method according to claim 15, wherein said radiating element has meander shape.

21. The method according to claim 15, wherein a thin dielectric carrier, arranged for carrying said radiating element, comprising at least a first slit so as to enable a part of said carrier to fold into said second inlet, towards and on to said first contact area in said cavity in an axial direction going from said first inlet and towards said second inlet.

22. The method according to claim 21, wherein said meander comprises a second and a third slit so as to enable a part of said meander to fold into said second inlet and onto said first contact area in said cavity in an axial direction going from said second inlet and towards said first inlet.

23. The method according to claim 15, wherein said radiating element is a helical radiator.

24. A hand-held radio communication device comprising an antenna for receiving and transmitting electromagnetic radiation comprising a radiating element and a base, said radiating element having an element part, said base comprising a cavity extending mainly in an axial direction and at least a first inlet to said cavity, wherein a contact means being comprised of one single element and being arranged for creating coupling between said radiating element and a feed member, said radiating element being arranged so that at least a part of said radiating element is covering a first contact area on an inside wall of said base, said contact means being arranged to be introduced into the cavity through the first inlet, said contact means is arranged to exert a force against said first contact area, said force enabling coupling between said element part of said radiating element and said contact means, and that said contact means is arranged to enable coupling with said feed member.

25. The hand-held radio communication device according to claim 24, wherein said antenna device further comprises a first extendable radiating whip, said contact means further being arranged to exert a contact force against said radiating whip when said radiating whip is in an extended position so that said force enables coupling between said extended radiating whip and said feed member.

26. The hand-held radio communication device according to claim 24, wherein said contact means extends out from said base.

27. The hand-held radio communication device according to claim 24, wherein said radiating element is arranged mainly in the cavity of said base.

28. The hand-held radio communication device according to claim 24, wherein said at least first inlet to said cavity is in a radial direction, said radiating element is arranged mainly on the outside of said base, said radiating element being arranged to at least partly fold into said cavity through said first inlet towards and on to said first contact area.

29. The hand-held radio communication device according to claim 24, wherein said contact means is a contact spool, said contact spool is arranged to be introduced into said cavity from one end of said base in an axial direction, a side of said contact spool is forced against said first contact area through pressure forces from the surrounding walls providing contact between said contact spool and said part.

30. The hand-held radio communication device according to claim 24, wherein said contact means is a contact clip, said base further comprises a support means extending from one side in said cavity in a mainly radial direction, said contact clip is being retained between a support area, said support means and said first contact area so as to create a contact force between said contact clip and said first contact area, enabling coupling between said contact clip and said radiating element.

31. The hand-held radio communication device according to claim 24, wherein said coupling between said contact means and said part is conductive.

32. The hand-held radio communication device according to claim 24, wherein said coupling between said contact means and said part is capacitive.

33. The hand-held radio communication device according to claim 24, wherein said coupling between said contact means and said part is inductive.

34. The hand-held radio communication device according to claim 24 wherein said radiating element has meander shape.

35. The hand-held radio communication device according to claim 34, wherein said meander comprises at least a first slit so as to enable a part of said meander to fold into said first inlet towards and on to said first contact area in said cavity.

36. The hand-held radio communication device according to claim 24, wherein said radiating element is a helical radiator.

* * * * *